US011773834B2

(12) United States Patent
Liu et al.

(10) Patent No.: US 11,773,834 B2
(45) Date of Patent: Oct. 3, 2023

(54) LINEAR PERISTALTIC METERING PUMP

(71) Applicant: HUNAN ZENITHSUN TECHNOLOGY CO., LTD, Hunan (CN)

(72) Inventors: Zhen Liu, Hunan (CN); Bo Yang, Hunan (CN); Haijun Tao, Hunan (CN); Weiquan Cheng, Hunan (CN)

(73) Assignee: HUNAN ZENITHSUN TECHNOLOGY CO., LTD, Hunan (CN)

( * ) Notice: Subject to any disclaimer, the term of this patent is extended or adjusted under 35 U.S.C. 154(b) by 325 days.

(21) Appl. No.: 17/281,258

(22) PCT Filed: Jul. 11, 2019

(86) PCT No.: PCT/CN2019/095579
§ 371 (c)(1),
(2) Date: Mar. 30, 2021

(87) PCT Pub. No.: WO2020/063033
PCT Pub. Date: Apr. 2, 2020

(65) Prior Publication Data

US 2022/0003228 A1 Jan. 6, 2022

(30) Foreign Application Priority Data

Sep. 30, 2018 (CN) ..... 201811157271.2

(51) Int. Cl.
*F04B 13/00* (2006.01)
*F04B 43/00* (2006.01)
(Continued)

(52) U.S. Cl.
CPC ..... *F04B 13/00* (2013.01); *F04B 43/0009* (2013.01); *F04B 43/0018* (2013.01);
(Continued)

(58) Field of Classification Search
CPC .. F04B 13/00; F04B 43/1215; F04B 43/1223; F04B 43/0009; F04B 43/0018;
(Continued)

(56) References Cited

U.S. PATENT DOCUMENTS 2,094,524 A * 9/1937 Busch ..... H01J 9/385 141/285
2,466,618 A * 4/1949 Stocks ..... F04B 43/1223 417/477.14
(Continued)

FOREIGN PATENT DOCUMENTS

CN 87216801 10/1988
CN 2935151 8/2007
(Continued)

OTHER PUBLICATIONS

"International Search Report (Form PCT/ISA/210) of PCT/CN2019/095579", dated Oct. 16, 2019, with English translation thereof, pp. 1-6.

*Primary Examiner* — Charles G Freay
(74) *Attorney, Agent, or Firm* — JCIP GLOBAL INC.

(57) ABSTRACT

A linear cleaning peristaltic metering pump includes a pump body, a hose fixing accessory and an anti-backflow accessory. The hose fixing accessory is configured for arranging a working hose. The anti-backflow accessory is configured for clamping and loosening the working hose. The pump body is configured for performing reciprocating motion to clamp or loosen the working hose, thereby realizing a pumping effect by metering pump. The anti-backflow accessory is in cooperation with the pump body. The pump body comprises a roller lifting assembly, a roller hose-pressing assembly, a pump body outer cover assembly and a power transmission part. The power transmission part is configured for driving the roller lifting assembly to perform lifting
(Continued)

linear motion, thereby driving the roller hose-pressing assembly to move and to clamp or loosen the working hose.

9 Claims, 17 Drawing Sheets

(51) Int. Cl.

| | |
|---|---|
| ***F04B 43/12*** | (2006.01) |
| *F04B 45/08* | (2006.01) |
| *F04B 53/00* | (2006.01) |
| *F04B 43/09* | (2006.01) |
| *B05B 9/04* | (2006.01) |

(52) U.S. Cl.
CPC ..... *F04B 43/1215* (2013.01); *F04B 43/1223* (2013.01); *B05B 9/042* (2013.01); *F04B 43/09* (2013.01); *F04B 45/08* (2013.01); *F04B 53/00* (2013.01)

(58) Field of Classification Search
CPC ..... F04B 43/09; F04B 45/08; F04B 53/00; B05B 9/042
USPC ..... 417/474
See application file for complete search history.

(56) References Cited

U.S. PATENT DOCUMENTS 4,880,149 A * 11/1989 Scholefield ..... G01F 11/088 417/474
10,987,683 B1 * 4/2021 Marrs ..... B05B 7/0408

FOREIGN PATENT DOCUMENTS

| | | | | |
|---|---|---|---|---|
| CN | 201554628 | | | 8/2010 |
| CN | 103557144 | A | * | 2/2014 |
| CN | 205117650 | | | 3/2016 |
| CN | 109098956 | | | 12/2018 |
| CN | 209083531 | | | 7/2019 |
| CN | 107269502 | A | * | 10/2020 |
| CN | 107288860 | B | * | 4/2021 |
| EP | 3168472 | A1 | * | 9/2016 |
| JP | S55139990 | | | 11/1980 |
| JP | 2003227461 | | | 8/2003 |
| SU | 1280190 | | | 12/1986 |

* cited by examiner

LINEAR PERISTALTIC METERING PUMP

CROSS-REFERENCE TO RELATED APPLICATION

This application is a 371 of international application of PCT application serial no. PCT/CN2019/095579, filed on Jul. 11, 2019, which claims the priority benefit of China application no. 201811157271.2, filed on Sep. 30, 2018. The entirety of each of the above mentioned patent applications is hereby incorporated by reference herein and made a part of this specification.

BACKGROUND

Technical Field

The present invention mainly relates to the technical field of peristaltic pumps, in particular to a linear cleaning peristaltic metering pump.

Description of Related Art

The peristaltic pumps of prior art involve rotary peristaltic pumps and linear peristaltic pumps. Both of the peristaltic pumps share a common feature, that is, one side of a working hose 3 is provided with a flexible rolling roller 2, and the other side of the working hose 3 is provided with a relatively fixed back plate 1, and the working hose 3 is pressed against the back plate 1 by the flexible rolling roller 2, thereby achieving the purpose of peristaltic fluid transmission, as shown in FIG. 1 and FIG. 2.

Two major technical problems exist in the prior art of hose pressing by the fixed side and the movable roller 2 on the other side, first one is that an inner wall of the working hose 3 is easily worn out, and second one is that removal of the fixed back plate 1 necessary for hose replacement is inconvenient. It is easy to understand the problem that the fixed back plate 1 requires to be removed to replace the hose. That is, the pump cover should be opened before replacing the hose in the peristaltic pump of prior art.

The hose pressing of prior art accelerates the wear course of the inner wall of hose. Referring to FIG. 3, taking the linear peristaltic pump for example, the causes of wear in prior art are analyzed as follows. The hose pressing operation of the peristaltic pump is divided into four processes marked as four states, respectively. One side of the working hose 3 close to the fixed back plate 1 is called a side A, and another side of the working hose 3 close to the roller 2 is called a side B.

State (a) is an initial state, in which the working hose 3 is in a natural state and free from a pressure or a tensile force of the roller 2. Suppose that a radius of the roller 2 is R and a wall thickness of the working hose 3 is t.

State (b) is a critical state, in which the side A just contacts the side B upon a compression of the working hose 3 by the roller 2. In this state, the side A and the side B are in a critical contact position and no force is generated therebetween; the wall thickness t at the side A of the working hose 3 remains unchanged. Since the side B of the working hose 3 is stretched under compression from the roller 2 at the contact position, suppose that a wall thickness of the side B of the working hose 3 at the contact position with the roller 2 is t1, and an arc radius at the contact position between the side B of the working hose 3 and the roller 2 is R1. According to tensile property of the object, it can be concluded that the wall thickness of the side B of the working hose 3 at the contact position with the roller 2 decreases, i.e., t>t1, and R1=R+t1.

In state (c), the roller 2 presses tightly against the working hose 3. Since the fluid in the working hose 3 is pressurized during the pumping process, the side A should be in fully contact with the side B during the operation to maintain a certain pressing force, thereby pumping the fluid stably. In this state, an action-reaction force pair exists between the side A and the side B, and the action forces exerted on the side A and the side B are provided by an elastic deformation of the working hose 3. In that case, therefore, side A and side B have the same wall thickness at the contact position. Suppose that the wall thickness of the contact parts between the side A and the side B of the working hose 3 is t2, a chord length of the contact part is L, an angle corresponding to the chord length is a, and an arc radius of the contact parts is R2. According to force analysis, it is easy to conclude that t>t1>t2, and R2=R+t2, thus R1>R2.

In State (d), the roller 2 presses tightly against the working hose 3 and rolls forward for a certain distance, there must be a state in which the wall thickness of the side B of the hose is reset to t1 and the arc radius to R1, which is supposed to be the state (d).

Further qualitative analysis is done according to the above-described states.

In the process from the state (a) to the state (b), since there is no contact between the side A and side B, there is no friction or wear between the side A and the side B.

In the process from the state (b) to the state (c), since R1>R2, indicating that an arc length of the inner wall at the side B decreases, and the linear chord length L at the side A is changed to an arc length under compression, thus the arc length of the inner wall of the side A increases, and an extension of the side A and an contraction of the side B are completed in the contact process. Therefore, relative motion exists between the side A and the side B, which is prone to wear.

On the contrary, in the process from the state (c) to the state (d), the arc length of the inner wall of the side B increases, and that of the side A restores and decreases. Similarly, the contraction of the side A and the extension of the side B are completed in the contact process. Therefore, the relative motion exists between the side A and the side B, which is prone to wear.

Likewise, the rotary peristaltic pumps also have the wear-out problem. The wear problem caused by relative motion exists in case of the pump body rotating diameter larger than the diameter of roller 2, and the wear increases with the diameter difference and the relative motion intensity.

SUMMARY

The technical problem to be solved by the present invention is to provide a linear cleaning peristaltic metering pump with simple structure, convenient operation, high precision and long service life to solve the technical problems of prior art.

To solve the above-described technical problem, the present invention adopts the following technical solution.

A linear cleaning peristaltic metering pump includes a pump body arranged on a machine countertop, a hose fixing accessory and an anti-backflow accessory. The hose fixing accessory is configured for arranging a working hose. The anti-backflow accessory is configured for clamping and loosening the working hose. The pump body is configured for performing reciprocating motion to clamp or loosen the working hose, thereby realizing a pumping effect by metering pump. The anti-backflow accessory is in cooperation with the pump body. The pump body comprises a roller lifting assembly, a roller hose-pressing assembly, a pump body outer cover assembly and a power transmission part. The power transmission part is configured for driving the roller lifting assembly to perform lifting-type linear motion, thereby driving the roller hose-pressing assembly to move and to clamp or loosen the working hose.

As a further improvement of the present invention, the roller lifting assembly comprises a lifting screw assembly and a guide shaft. A middle section of the guide shaft is arranged on a linear bearing. Two ends of the guide shaft are respectively connected with an upper guide shaft fixing plate and a lower guide shaft fixing plate, and the lifting screw assembly is connected with the lower guide shaft fixing plate and driven by the power transmission part, thereby driving the guide shaft to perform lifting motion.

As a further improvement of the present invention, the guide shaft is provided with a gasket set.

As a further improvement of the present invention, the guide shaft is arranged in a vertical direction.

As a further improvement of the present invention, the power transmission part comprises a lifting drive motor, and the lifting drive motor is connected with the lifting screw assembly through a coupling to perform driving motion.

As a further improvement of the present invention, the roller hose-pressing assembly comprises a spline ball sleeve, a lifting spline shaft, a roller mounting base and two hose-pressing rollers. A lower end of the lifting spline shaft is connected with a slewing bearing and the spline ball sleeve. The spline ball sleeve is arranged on a spline sleeve holder. The hose-pressing roller is arranged on the roller mounting base. A top end of the lifting spline shaft is connected to a driving swing rod and drives the driving swing rod to move. The driving swing rod is connected to two symmetrically arranged driven swing rods through a universal crosshead connecting rod, and each of the driven swing rods is connected with one of the hose-pressing rollers. Driven by the lifting spline shaft, the two driven swing rods drive the hose-pressing rollers to move towards each other to clamp or loosen the working hose.

As a further improvement of the present invention, the power transmission part further comprises a roller hose-pressing drive motor, a hose-pressing swing rod and a hose-pressing connecting rod. The roller hose-pressing drive motor is connected with the roller hose-pressing assembly for driving through the hose-pressing swing rod and the hose-pressing connecting rod.

As a further improvement of the present invention, the pump body outer cover assembly comprises a pump body seat, a pump body cover, a pump top cover and a pump top hood. The pump body outer cover assembly is designed in split-type structure. The pump body cover is arranged on the pump body seat; and the pump top cover is located at a top end of the pump body cover. The pump top hood is arranged on the pump top cover.

As a further improvement of the present invention, the hose fixing accessory comprises a vertical hose fixing rod, an elastic joint holder, an inner joint and an outer joint. The vertical hose fixing rod is vertically arranged on a side of the pump body, and the vertical hose fixing rod is provided with more than one elastic joint holder, inner joint and outer joint to fix the working hose.

As a further improvement of the present invention, the anti-backflow accessory comprises a hose-clamping drive motor, a hose-clamping transmission shaft, a hose-clamping swing rod, a hose-clamping connecting rod, a slideway mounting plate, a slideway slider, a slider mounting plate, a pre-pressing limit stop, a hose-clamping limit stop, a movable pre-pressing piece and a movable hose-clamping piece. The hose-clamping transmission shaft is connected to the driving end of the hose-clamping drive motor. One end of the hose-clamping swing rod is connected with the hose-clamping transmission shaft, and the other end of the hose-clamping swing rod is connected to a sliding assembly through the hose-clamping connecting rod. The sliding assembly comprises the slideway mounting plate, the slideway slider and the slider mounting plate.

As a further improvement of the present invention, the pre-pressing limit stop, the hose-clamping limit stop, the movable pre-pressing piece and the movable hose-clamping piece form a clamping part, and the clamping part is arranged on the slideway slider.

As a further improvement of the present invention, the movable pre-pressing piece and the pre-pressing limit stop are located at one side of the sliding assembly, and the movable hose-clamping piece is located at the other side of the sliding assembly. The movable pre-pressing piece and the pre-pressing limit stop are arranged in relative positions to form a first space for the working hose to pass therethrough. The movable hose-clamping piece and the corresponding adjacent hose-clamping limit stop are arranged in a relative position to form a second space for the working hose to pass therethrough. The working hose is deposited in the first space and the second space.

As a further improvement of the present invention, the guide shaft in the roller lifting assembly uses the slideway slider guiding technology and other guiding structures.

As a further improvement of the present invention, the anti-backflow device adopts a check valve anti-backflow device or other anti-backflow devices.

As a further improvement of the present invention, two or more sets of pump bodies are arranged in parallel for peristalsis of two or more working hoses at the same time.

Compared with the prior art, the present invention has the advantages as follows.

1. The linear cleaning peristaltic metering pump of the present invention has simple and compact structure, drives the rollers by means of the guide shaft, and has good synchronization performance and high transmission accuracy. Further, it is designed in a closed structure with good tightness, which makes it more suitable for working in the aseptic production environment. In addition, the lifting-type linear motion adopted significantly decreases dimensions and floor space of overall equipment.

2. The linear cleaning peristaltic metering pump of the present invention is simple in structure and convenient to use. The flexible rolling hose-pressing rollers are symmetrically arranged on two sides of the hose, the two rollers are equal in diameter, and the fixed back plate of prior art is replaced by the roller arranged on one side. The changes in the wall thickness and radius at the side A of the hose are completely synchronous and identical to that of the side B during the hose pressing process by the rollers, thus avoid relative motion between the side A and the side B, thereby significantly decreasing the inner wall wear of the hose. Meanwhile, as the roller on one side replaces the fixed back plate of prior art, the hose replacement is available by opening the movable roller without removing the fixed back plate, thereby simplifying and facilitating the operation.

3. The linear cleaning peristaltic metering pump of the present invention is designed with a leak-proof hose clamp, and is simple in structure and convenient to use. Since the movable hose-clamping piece and the movable pre-pressing piece are arranged on the same slider mounting plate, they are in completely synchronous motion. The hose-clamping limit stop and the pre-pressing limit stop are just staggered. Therefore, when the movable hose-clamping piece clamps the hose, the movable pre-pressing piece loosens the hose to enlarge the hose line volume and suck the back-flow fluid, thereby preventing leakage and drip.

DESCRIPTION OF THE EMBODIMENTS

The present invention will be further described in detail in combination with accompanying drawings and embodiments.

Figure 1:
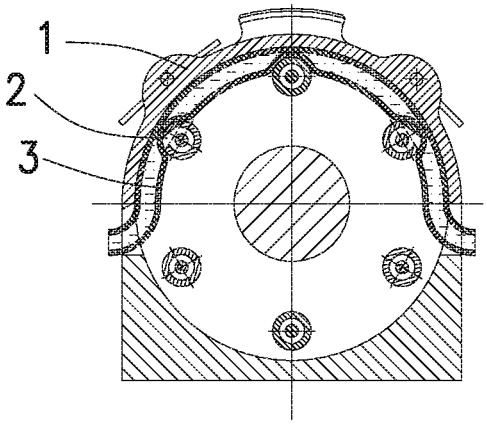
FIG. 1 (PRIOR ART)
FIG. 1 is a structural diagram of a hose-pressing structure of a rotary peristaltic pump of prior art.
Figure 2:
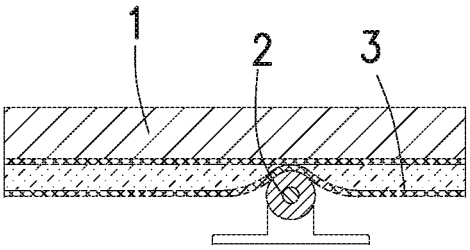
FIG. 2 (PRIOR ART)
FIG. 2 is a structural diagram of a hose-pressing structure of a linear peristaltic pump of prior art.
Figure 3:
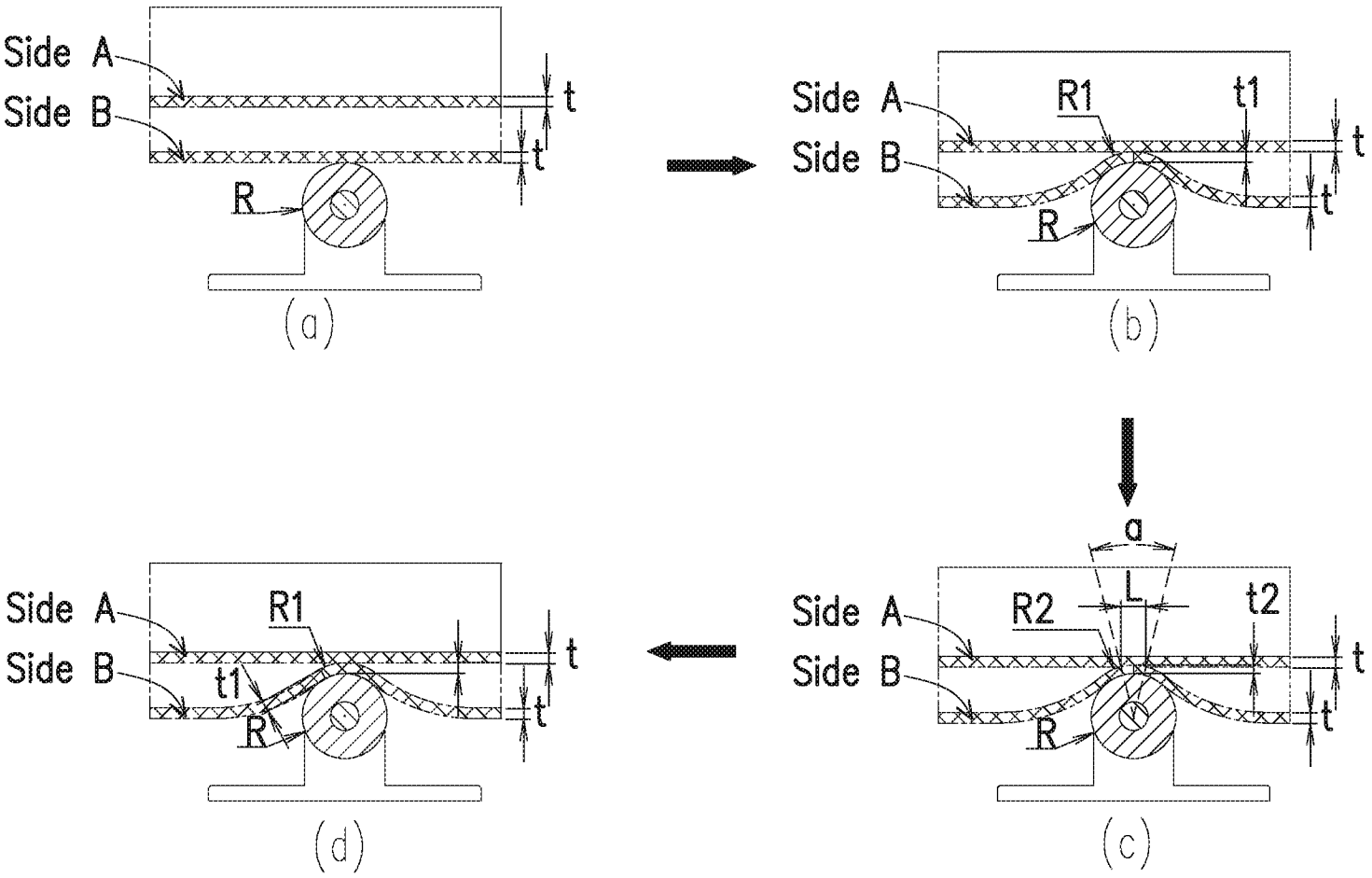
FIG. 3 (PRIOR ART)
FIG. 3 is a schematic diagram for analyzing working states of the hose pressing of prior art.
Figure 4:
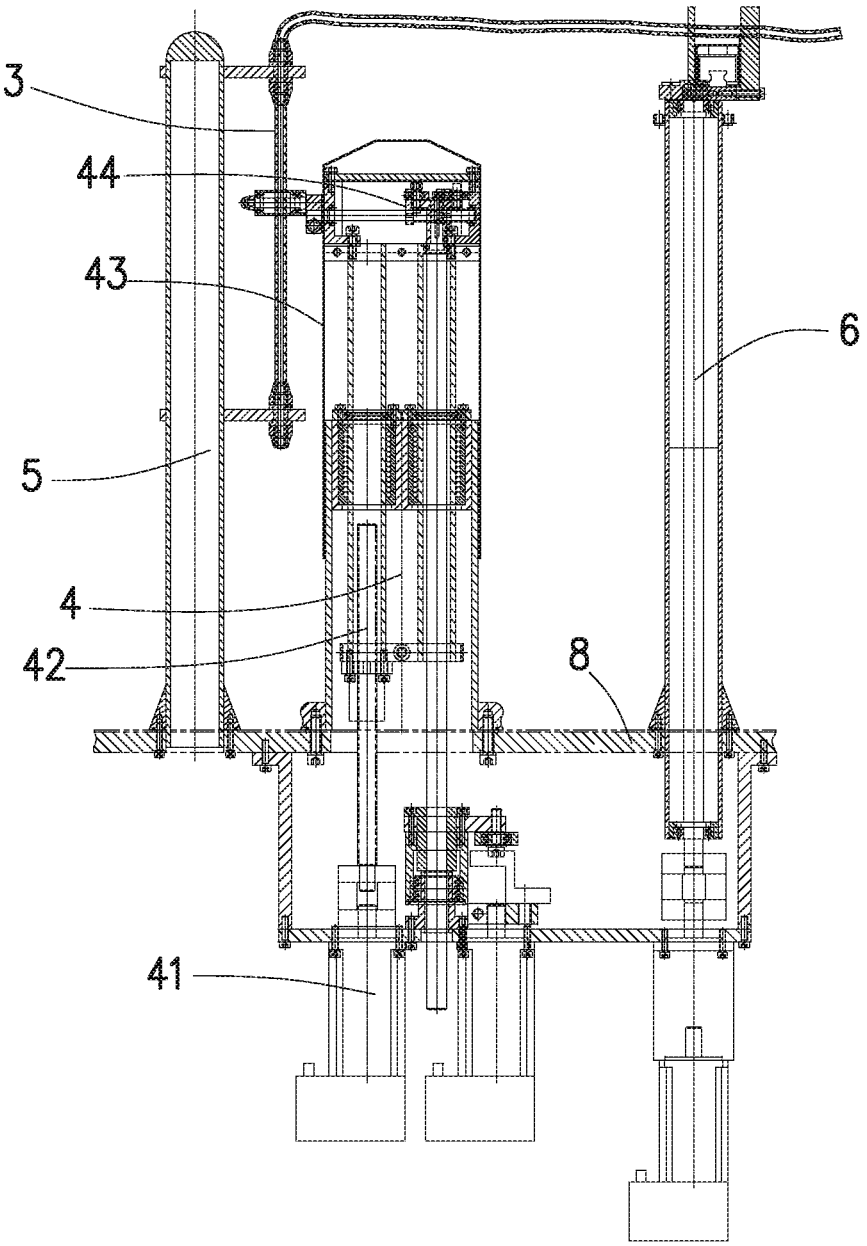
FIG. 4 is a structural diagram of the present invention.
Figure 5:
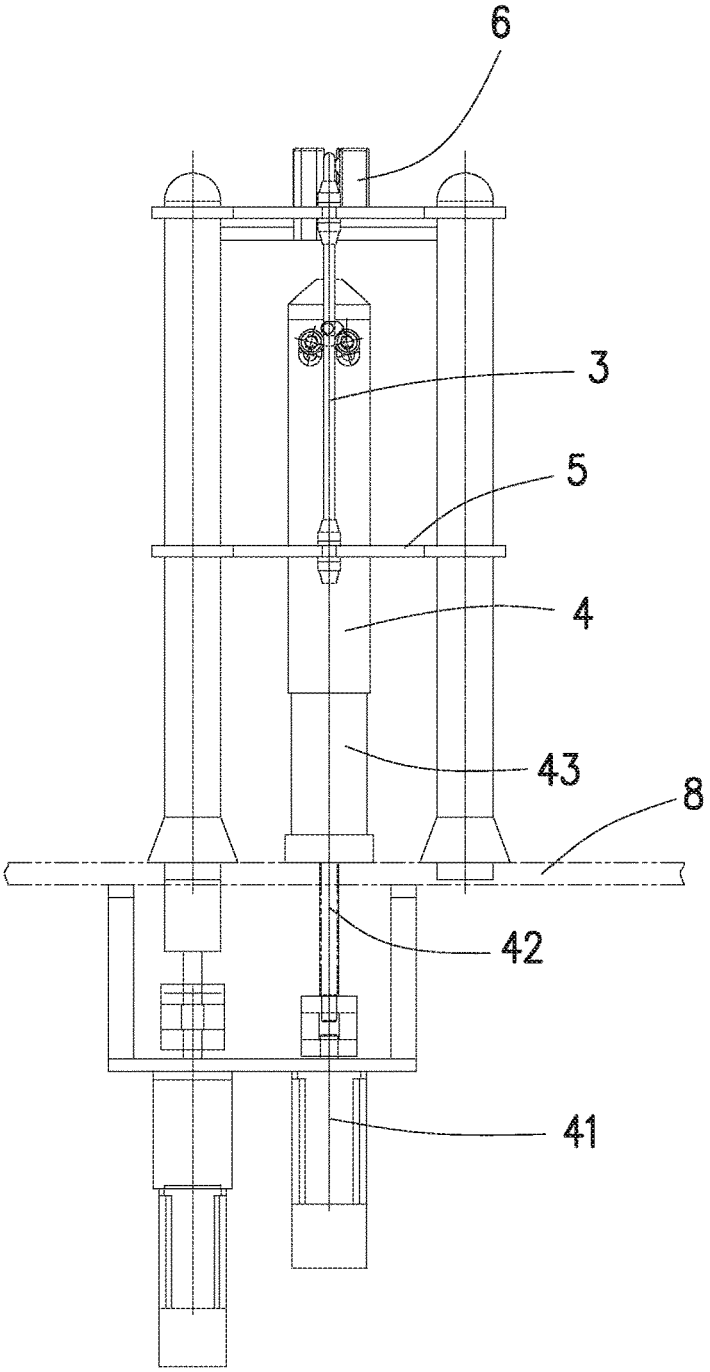
FIG. 5 is a left view of FIG. 4.
Figure 6:
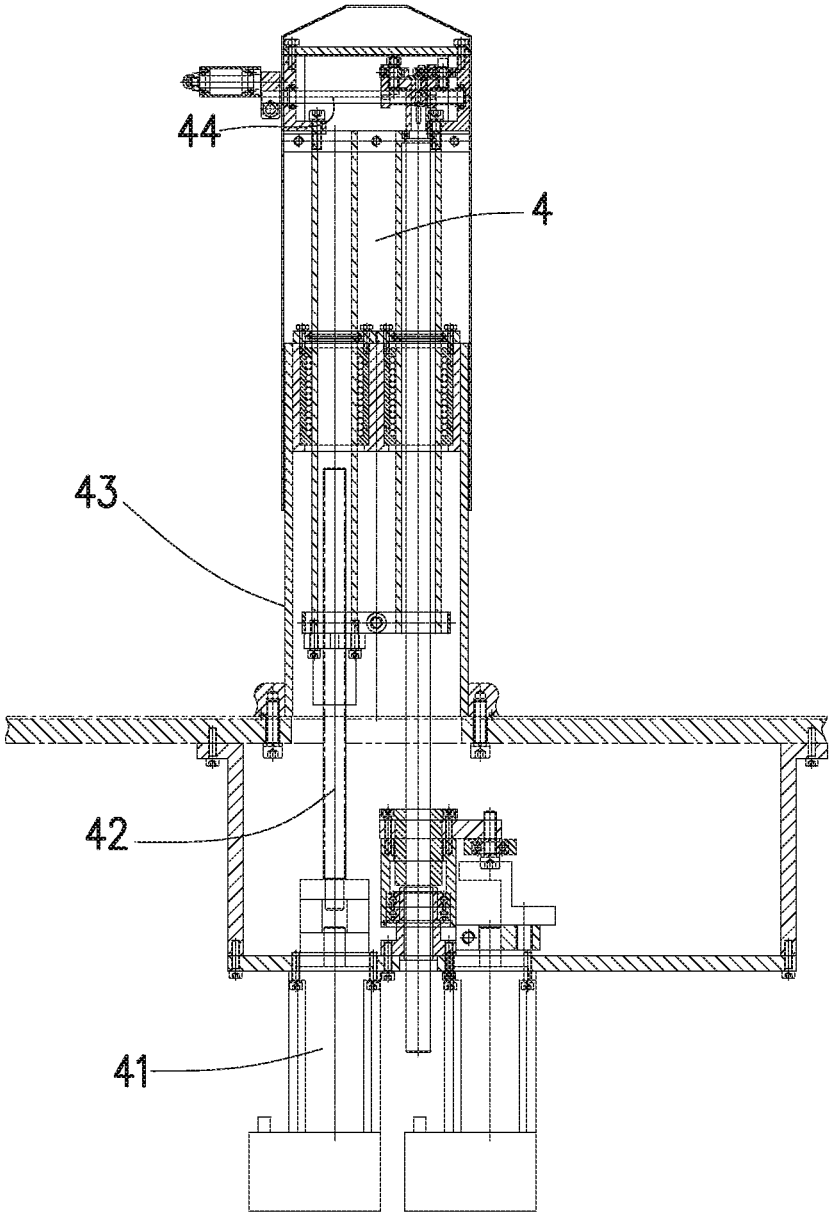
FIG. 6 is a structural diagram of a pump body of the present invention.

Referring to FIG. 4 to FIG. 6, a linear cleaning peristaltic metering pump includes a pump body 4 arranged on a machine countertop 8, a hose fixing accessory 5 and an anti-backflow accessory 6. The hose fixing accessory 5 is used for arranging a working hose 3, the anti-backflow accessory 6 is used for clamping and loosening the working hose 3, and the pump body 4 is used for performing reciprocating motion to clamp or loosen the working hose 3, thereby realizing a pumping effect by metering pump. The anti-backflow accessory 6 is in cooperation with the pump body 4. The pump body 4 comprises a roller lifting assembly 42, a roller hose-pressing assembly 44, a pump body outer cover assembly 43 and a power transmission part 41. The power transmission part 41 is used for driving the roller lifting assembly 42 to perform lifting-type linear motion, thereby driving the roller hose-pressing assembly 44 to move and to clamp or loosen the working hose 3.

Figure 7:
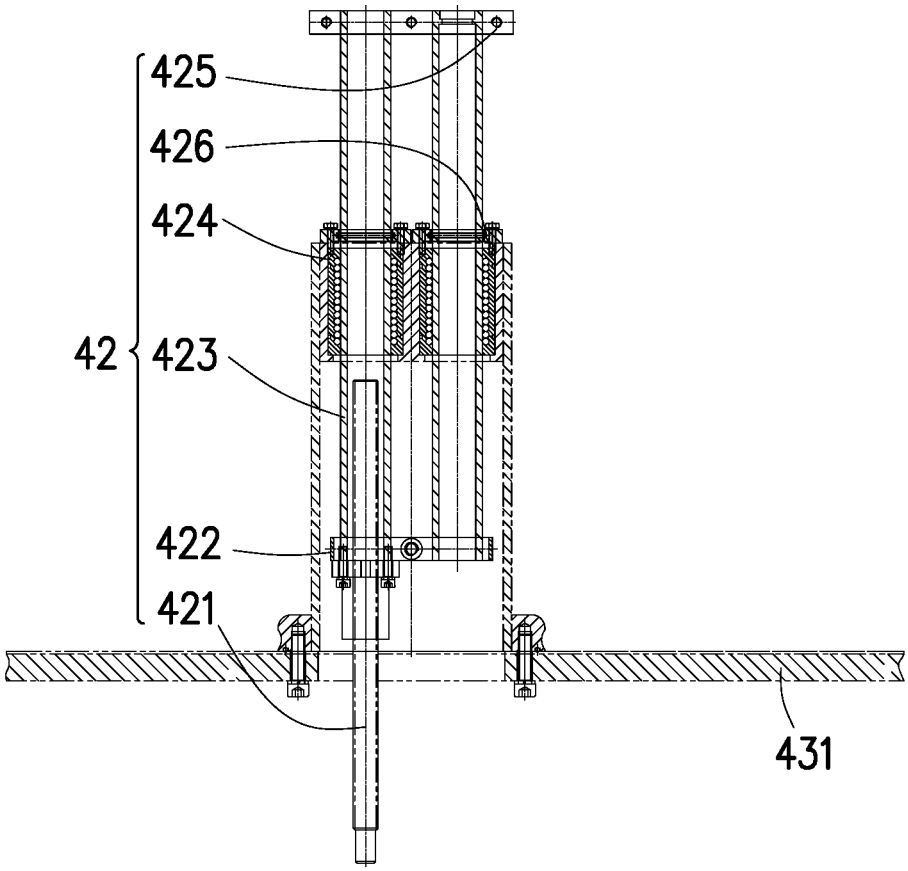
FIG. 7 is a structural diagram of a roller lifting assembly of the present invention.

Referring to FIG. 7, in the present embodiment, the roller lifting assembly 42 comprises a lifting screw assembly 421, a lower guide shaft fixing plate 422, a guide shaft 423 (a hollow guide shaft in the present embodiment), a linear bearing 424, an upper guide shaft fixing plate 425 and a gasket set 426. A middle section of the guide shaft 423 is arranged on the linear bearing 424. Two ends of the guide shaft 423 are respectively connected with the upper guide shaft fixing plate 425 and the lower guide shaft fixing plate 422. The lifting screw assembly 421 is connected with the lower guide shaft fixing plate 422 and driven by the power transmission part 41, thereby driving the guide shaft 423 to perform lifting motion. The gasket set 426 is arranged at the matching position between the guide shaft 423 and other parts to effectively seal the transmission part and completely isolate the oil contamination and particles generated in the transmission from the clean environment, thus the apparatus meets GMP of drug.

In the present embodiment, the guide shaft 423 is arranged in a vertical direction to decrease the floor space of overall equipment. Two ends of the guide shaft 423 are respectively provided with the upper guide shaft fixing plate 425 and the lower guide shaft fixing plate 422 to perform guiding motion and prevent rotation.

Figure 10:
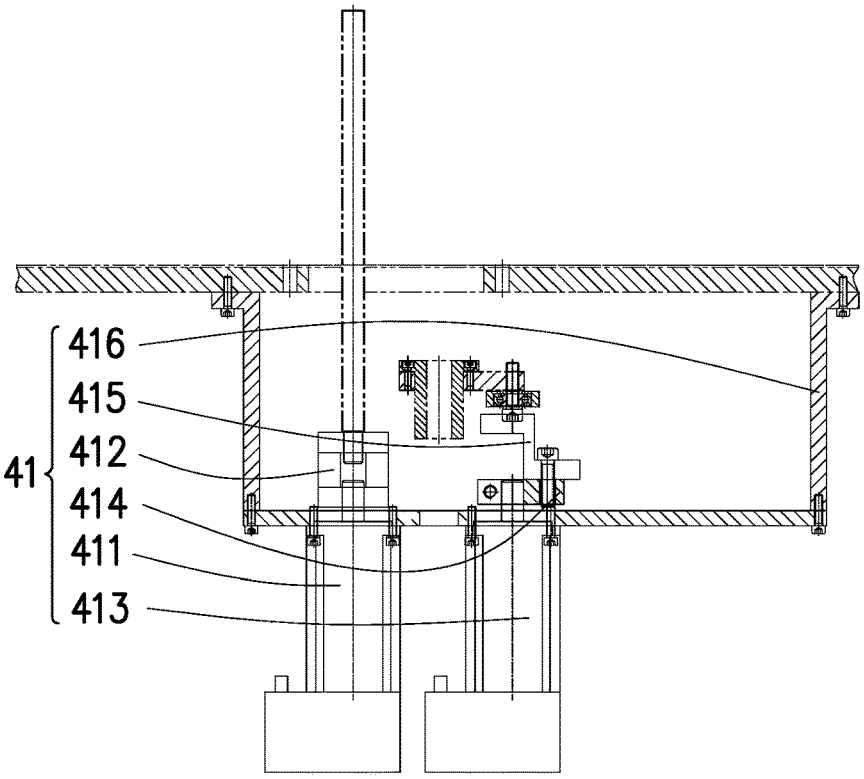
FIG. 10 is a structural diagram of a power transmission part of the present invention.

Referring to FIG. 10, in the present embodiment, the power transmission part 41 comprises a lifting drive motor 411, and the lifting drive motor 411 is connected with the lifting screw assembly 421 through a coupling 412 to perform driving motion.

Figure 8:
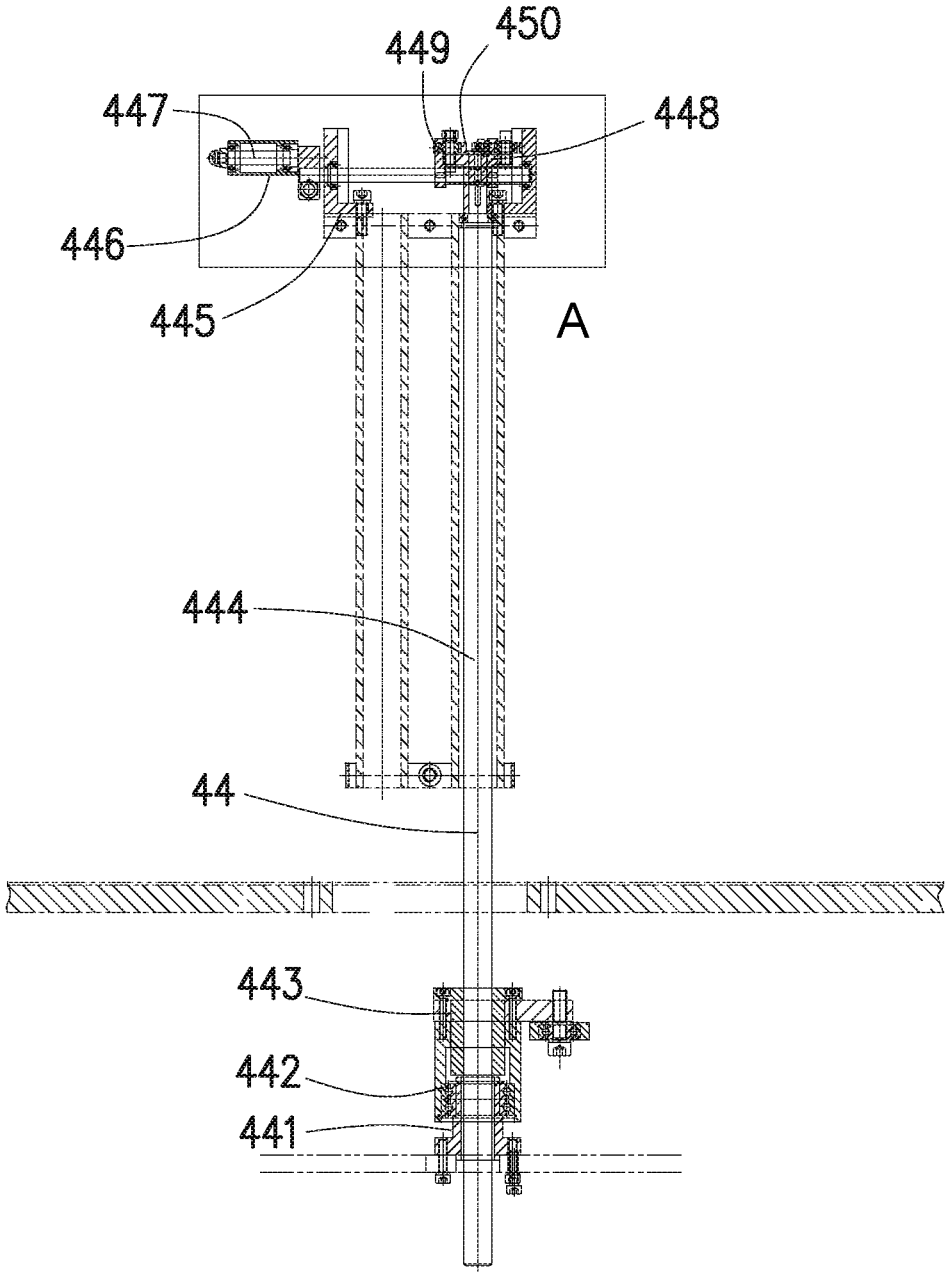
FIG. 8 is a structural diagram of a roller hose-pressing assembly of the present invention.
Figure 9:
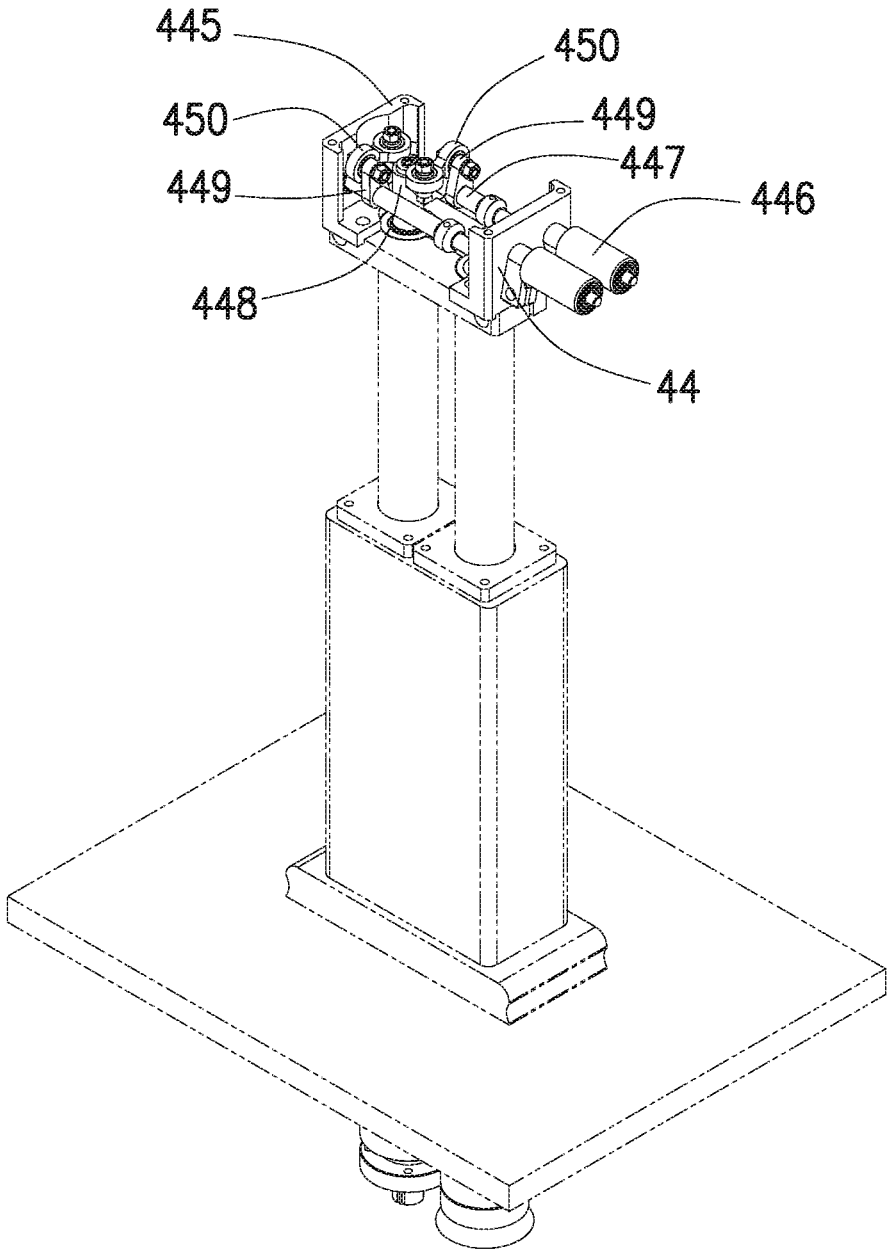
FIG. 9 is an isometric view of the roller hose-pressing assembly structure of the present invention.
Figure 19:
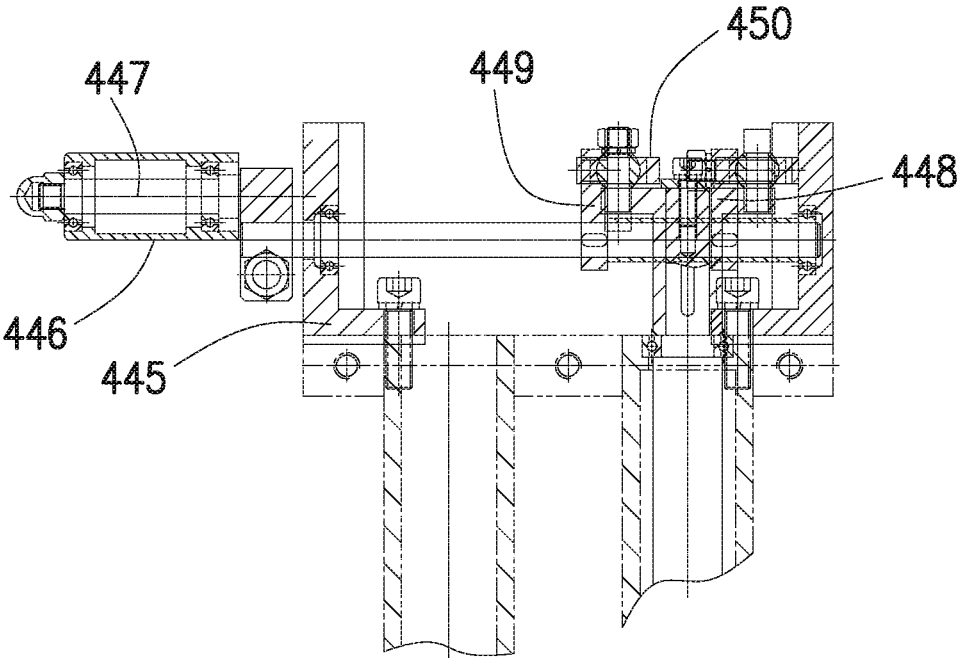
FIG. 19 is a partial enlargement view of part A in FIG. 8.

Referring to FIG. 8, FIG. 9 and FIG. 19, in the present embodiment, the roller hose-pressing assembly 44 comprises a spline sleeve holder 441, a slewing bearing 442, a spline ball sleeve 443, a lifting spline shaft 444, a roller mounting base 445, two hose-pressing rollers 446, an eccentric crankshaft 447, a driving swing rod 448, a driven swing rod 449 and a universal crosshead connecting rod 450. A lower end of the lifting spline shaft 444 is connected with the slewing bearing 442 and the spline ball sleeve 443. The spline ball sleeve 443 is arranged on a spline sleeve holder 441. The hose-pressing rollers 446 are arranged on the roller mounting base 445. A top end of the lifting spline shaft 444 is connected with the driving swing rod 448 and drives the driving swing rod 448 to move. The driving swing rod 448 is connected with two symmetrically arranged driven swing rods 449 through the universal crosshead connecting rod 450, and each of the driven swing rods 449 is connected with one of the hose-pressing rollers 446. Driven by the lifting spline shaft 444, the two driven swing rods 449 drive the hose-pressing rollers 446 to move towards each other to clamp or loosen the working hose 3.

Referring to FIG. 10, in the present embodiment, the power transmission part 41 further comprises a roller hose-pressing drive motor 413, a hose-pressing swing rod 414 and a hose-pressing connecting rod 415. The roller hose-pressing drive motor 412 is connected with the roller hose-pressing assembly 44 for driving through the hose-pressing swing rod 414 and the hose-pressing connecting rod 415. In the present embodiment, the roller hose-pressing drive motor 413 and the lifting drive motor 411 are arranged on a motor mounting frame 416.

Figure 11:
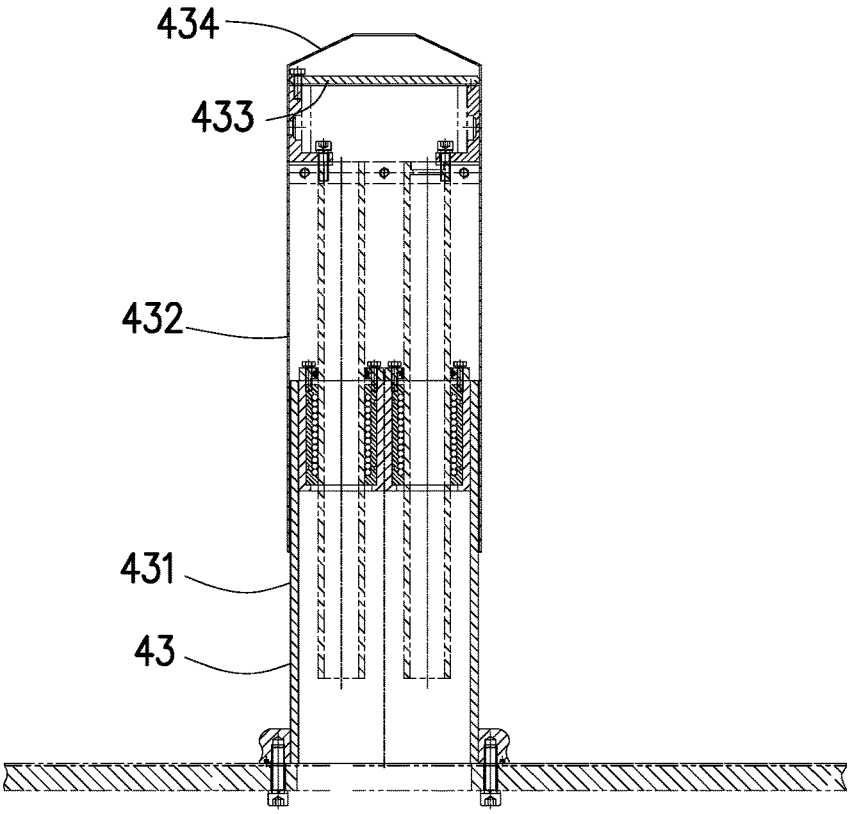
FIG. 11 is a structural diagram of a pump body outer cover assembly of the present invention.

Referring to FIG. 11, in the present embodiment, the pump body outer cover assembly 43 comprises a pump body seat 431, a pump body cover 432, a pump top cover 433 and a pump top hood 434. The pump body outer cover assembly 43 is designed in split-type structure. The pump body cover 432 is arranged on the pump body seat 431, and the pump top cover 433 is located at the top of the pump body cover 432. The pump top hood 434 is arranged on the pump top cover 433.

Figure 15:
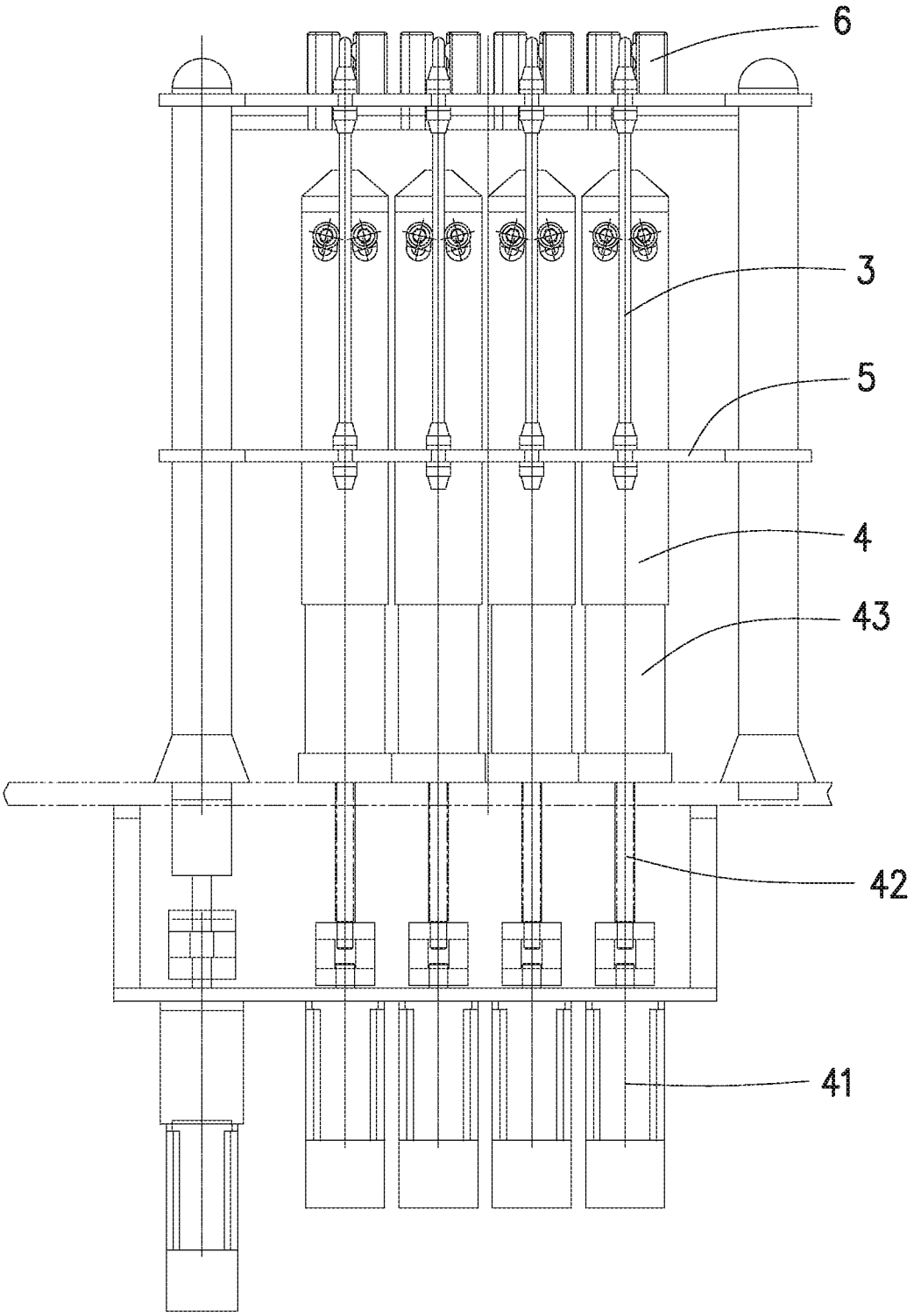
FIG. 15 is a structural diagram of multi-group pump bodies arranged in parallel in another embodiment of the present invention.
Figure 16:
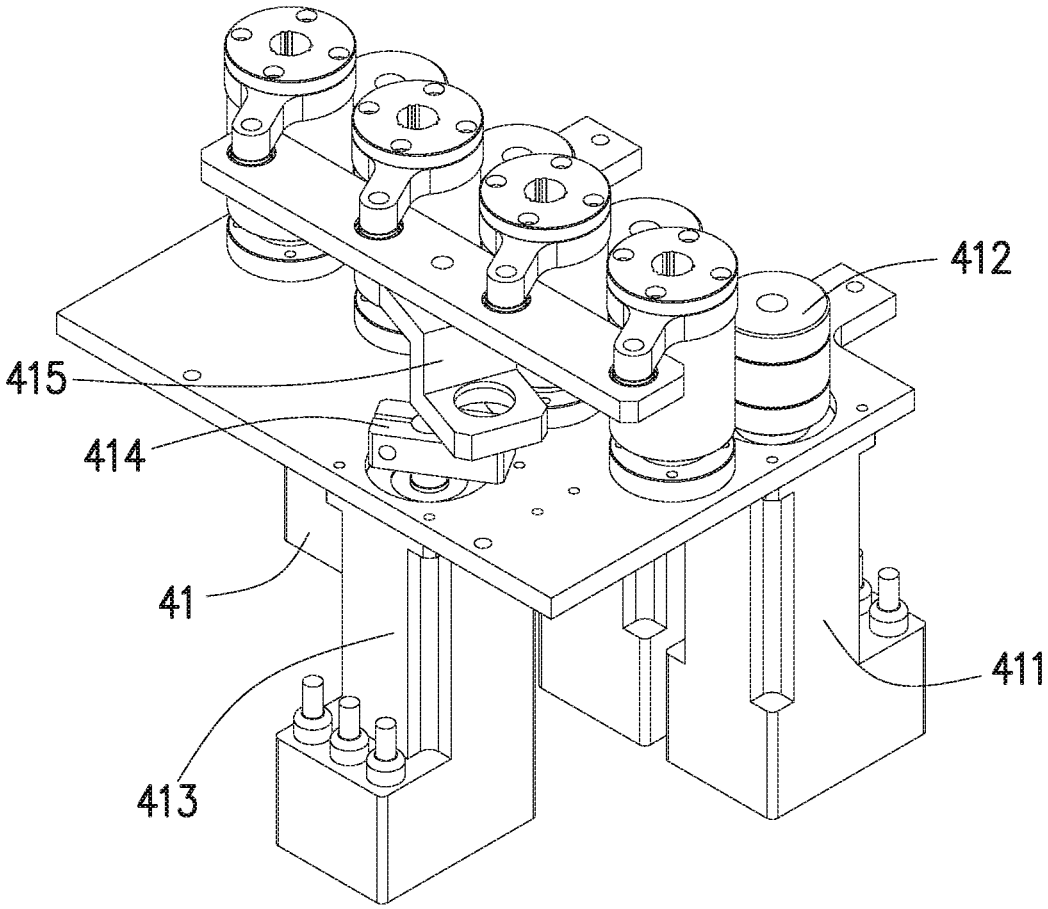
FIG. 16 is another view of the multi-group pump bodies arranged in parallel in another embodiment of the present invention.

It should be appreciated that in other embodiments, such as another embodiment shown in FIG. 15 and FIG. 16, the pump body 4 may be a multi-group combination structure operating a plurality of working hoses 3 at the same time. This should also fall into the protection scope of the present invention.

Figure 12:
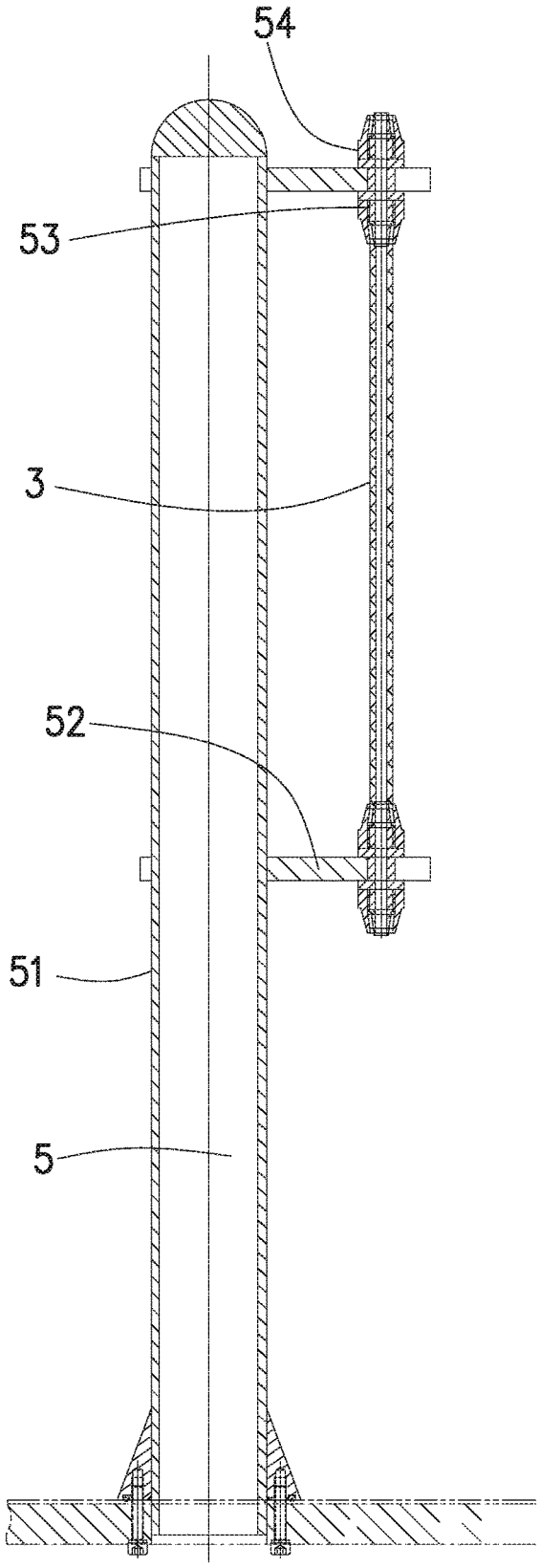
FIG. 12 is a structural diagram of a hose fixing accessory of the present invention.

Referring to FIG. 12, in the present embodiment, the hose fixing accessory 5 comprises a vertical hose fixing rod 51, an elastic joint holder 52, an inner joint 53 and an outer joint 54. The vertical hose fixing rod 51 is vertically arranged on a side of the pump body 4, and the vertical hose fixing rod 51 is provided with more than one elastic joint holder 52, inner joint 53 and outer joint 54 to fix the working hose 3.

Figure 13:
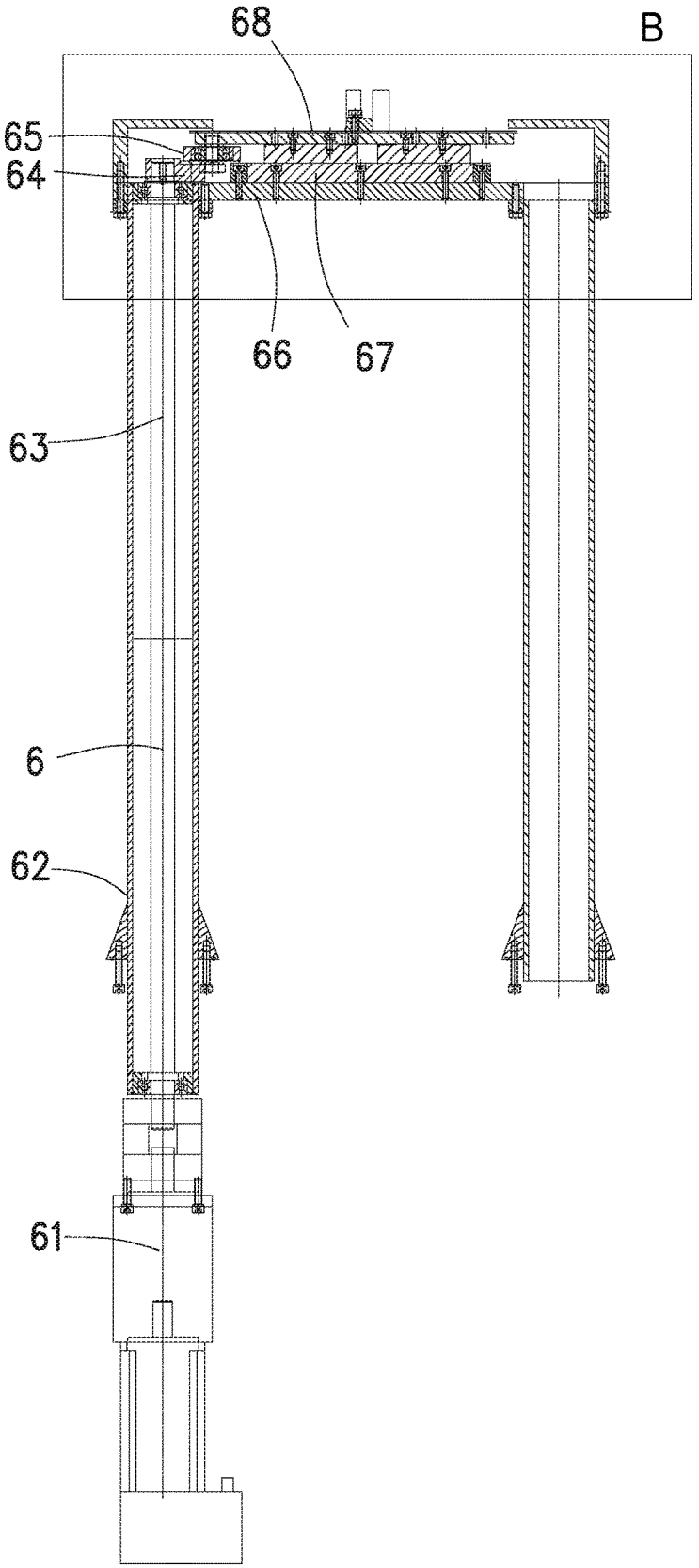
FIG. 13 is a structural diagram of an anti-backflow accessory of the present invention.
Figure 14:
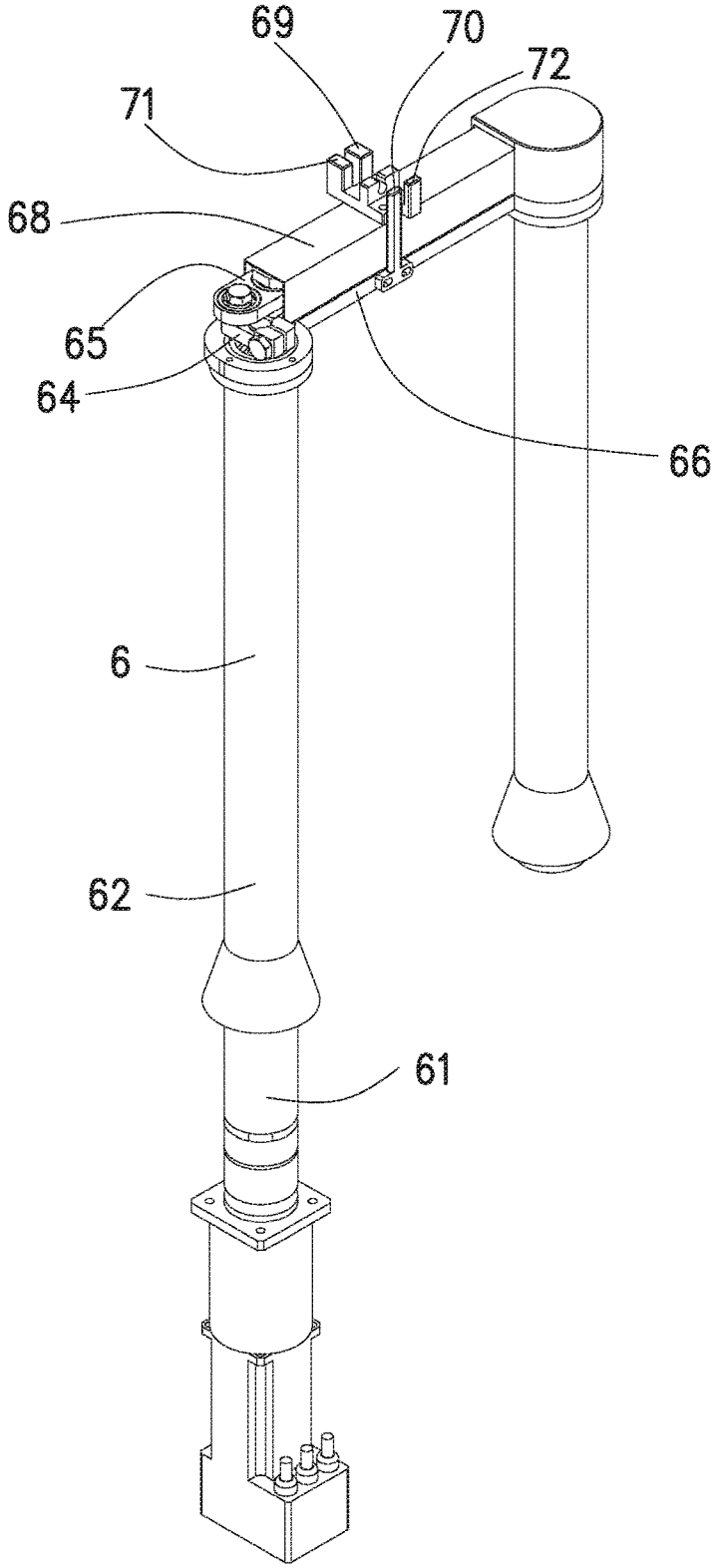
FIG. 14 is an isometric view of the anti-backflow accessory structure of the present invention.
Figure 20:
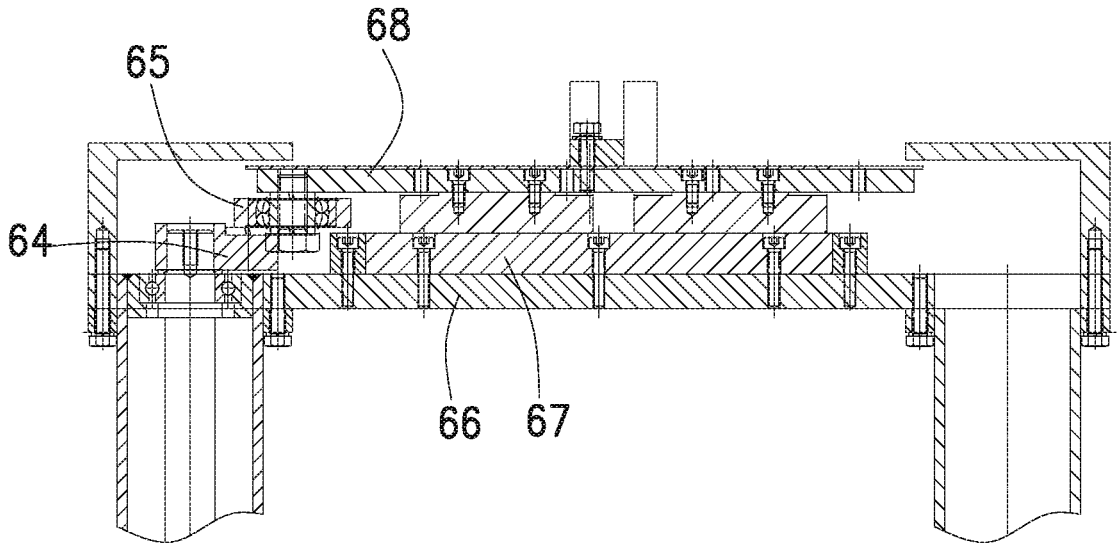
FIG. 20 is a partial enlargement view of part B in FIG. 13.

Referring to FIG. 13, FIG. 14 and FIG. 20, in the present embodiment, the anti-backflow accessory 6 comprises a hose-clamping drive motor 61, a hose-clamping mounting base 62, a hose-clamping transmission shaft 63, a hose-clamping swing rod 64, a hose-clamping connecting rod 65, a slideway mounting plate 66, a slideway slider 67, a slider mounting plate 68, a pre-pressing limit stop 69, a hose-clamping limit stop 70, a movable pre-pressing piece 71 and a movable hose-clamping piece 72. The hose-clamping transmission shaft 63 is arranged on the hose-clamping mounting base 62. The hose-clamping transmission shaft 63 is connected with the driving end of the hose-clamping drive motor 61. One end of the hose-clamping swing rod 64 is connected with the hose-clamping transmission shaft 63, and the other end of the hose-clamping swing rod 64 is connected with a sliding assembly through the hose-clamping connecting rod 65. The sliding assembly comprises the slideway mounting plate 66, the slideway slider 67 and the slider mounting plate 68. The slideway slider 67 may move linearly along a slideway on the slideway mounting plate 66. The pre-pressing limit stop 69, the hose-clamping limit stop 70, the movable pre-pressing piece 71 and the movable hose-clamping piece 72 form a clamping part, and the clamping part is arranged on the slideway slider 67. The movable pre-pressing piece 71 and the pre-pressing limit stop 69 are located at one side of the sliding assembly, and the movable hose-clamping piece 72 is located at the other side of the sliding assembly. The movable pre-pressing piece 71 and the pre-pressing limit stop 69 are arranged in relative positions to form a first space for the working hose 3 to pass therethrough. The movable hose-clamping piece 72 and the corresponding adjacent hose-clamping limit stop 70 are arranged in a relative position to form a second space for the working hose 3 to pass therethrough. The working hose 3 is deposited in the first space and the second space.

During operation, the working hose 3 passes between the movable hose-clamping piece 72 and the hose-clamping limit stop 70, and passes between the movable pre-pressing piece 71 and the pre-pressing limit stop 69. The hose-clamping drive motor 61 drives the hose-clamping transmission shaft 63, the hose-clamping swing rod 64 and the hose-clamping connecting rod 65 to move, thereby driving the movable hose-clamping piece 72 and the movable pre-pressing piece 71 arranged in the sliding assembly to move parallelly, and thereby clamping and loosening the working hose 3, and pre-pressing and loosening the working hose 3.

Since the movable hose-clamping piece 72 and the movable pre-pressing piece 71 are in completely synchronous motion, and since the hose-clamping limit stop 70 and the pre-pressing limit stop 69 are just staggered, when the movable hose-clamping piece 72 clamps the hose, the movable pre-pressing piece 71 loosens the flexible hose to enlarge the hose line volume and suck the back-flow fluid, thereby preventing leakage and drip.

Figure 17:
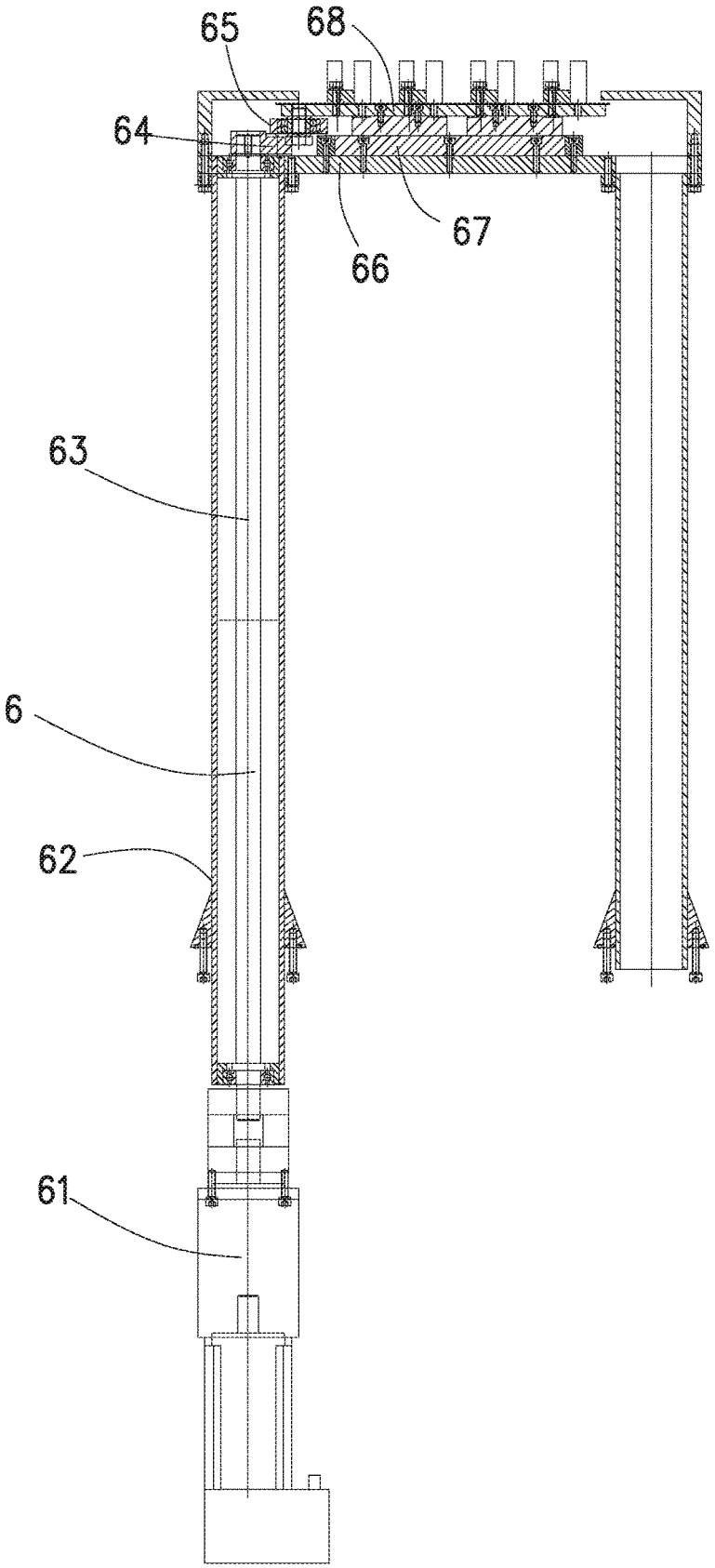
FIG. 17 is a structural diagram of multi-group anti-backflow accessories used in another embodiment of the present invention.
Figure 18:
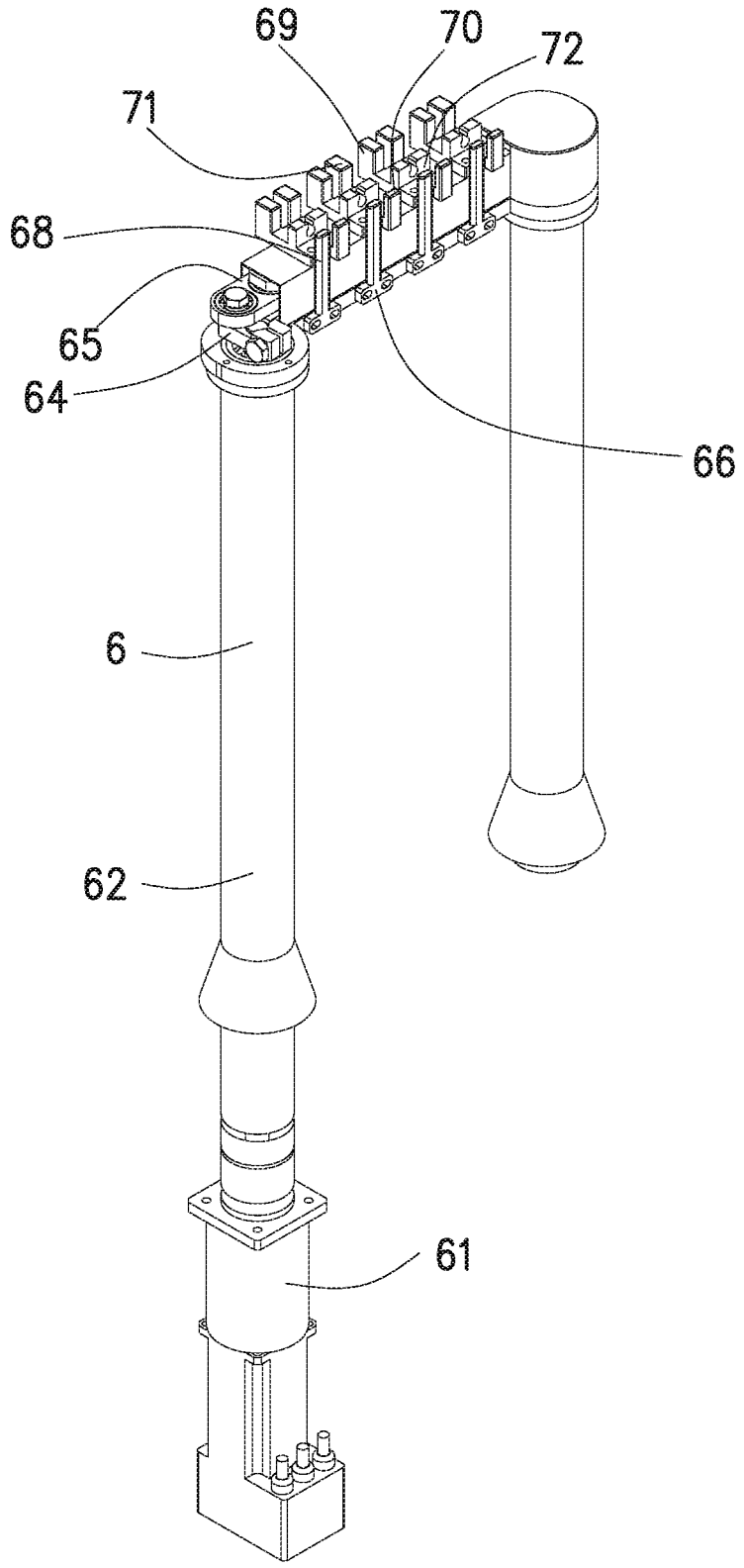
FIG. 18 is an isometric view of the multi-group anti-backflow accessories used in another embodiment of the present invention.

It should be appreciated that in other embodiments, such as another embodiment shown in FIG. 17 and FIG. 18, the anti-backflow accessory 6 may also be provided with a plurality of clamping parts to form a multi-group combination structure operating a plurality of working hoses 3 at the same time. This should also fall into the protection scope of the present invention.

The above are only preferred embodiments of the present invention, and the protection scope of the present invention is not limited to the embodiments described above. The technical solutions under the ideas of the present invention fall into the protection scope of the present invention. It should be pointed out that, for those ordinary skilled in the art, some improvements and modifications without departing from the principle of the present invention shall be deemed to fall into the protection scope of the present invention.

What is claimed is:

1. A linear peristaltic metering pump for operating a working hose comprising a pump body, a hose fixing accessory and an anti-backflow accessory, wherein the hose fixing accessory is configured for arranging the working hose; the anti-backflow accessory is configured for clamping and loosening the working hose; and the pump body is configured for performing reciprocating motion to clamp or loosen the working hose; the pump body comprises a lifter, a roller hose-pressing assembly including a first clamp, a pump body outer cover assembly and a power transmission part; and the power transmission part is configured for driving the lifter to perform a lifting and lowering linear motion, so as to drive the roller hose-pressing assembly to move and to clamp or loosen the working hose, wherein the hose fixing accessory comprises a vertical hose fixing rod, an elastic joint holder, an inner joint and an outer joint; the vertical hose fixing rod is vertically arranged on a side of the pump body; and the vertical hose fixing rod is provided with more than one elastic joint holder, inner joint and outer joint to fix the working hose, wherein the anti-backflow accessory comprises a second clamp, wherein the lifter comprises a lifting screw assembly and a guide shaft; a middle section of the guide shaft is arranged on a linear bearing; two ends of the guide shaft are respectively connected with an upper guide shaft fixing plate and a lower guide shaft fixing plate; and the lifting screw assembly is connected to the lower guide shaft fixing plate and is driven by the power transmission part, so as to drive the guide shaft to perform the lifting and lowering motion, wherein the power transmission part comprises a lifting drive motor, and the lifting drive motor is connected with the lifting screw assembly through a coupling to perform driving motion.

2. The linear peristaltic metering pump as recited in claim 1, wherein the guide shaft is provided with a gasket set.

3. The linear peristaltic metering pump as recited in claim 1, wherein the guide shaft is arranged in a vertical direction.

4. The linear peristaltic metering pump as recited in claim 1, wherein the roller hose-pressing assembly comprises a spline ball sleeve, a lifting spline shaft, a roller mounting base and two hose-pressing rollers; a lower end of the lifting spline shaft is connected with a slewing bearing and the spline ball sleeve; the spline ball sleeve is arranged on a spline sleeve holder; each hose-pressing roller is arranged on the roller mounting base; a top end of the lifting spline shaft is connected to a driving swing rod and drives the driving swing rod to move; the driving swing rod is connected to two symmetrically arranged driven swing rods through two universal crosshead connecting rods; and each of the driven swing rods is connected with one of the hose-pressing rollers; driven by the lifting spline shaft, the two driven swing rods drive the hose-pressing rollers to move towards each other to clamp or loosen the working hose.

5. The linear peristaltic metering pump as recited in claim 4, wherein the power transmission part comprises a roller hose-pressing drive motor, a hose-pressing swing rod and a hose-pressing connecting rod; the roller hose-pressing drive motor is connected with the roller hose-pressing assembly for driving through the hose-pressing swing rod and the hose-pressing connecting rod.

6. The linear peristaltic metering pump as recited in claim 1, wherein the pump body outer cover assembly comprises a pump body seat, a pump body cover, a pump top cover and a pump top hood; the pump body outer cover assembly is designed as a split-type structure; the pump body cover is arranged on the pump body seat; the pump top cover is located at a top end of the pump body cover, and the pump top hood is arranged on the pump top cover.

7. The linear peristaltic metering pump as recited in claim 1, wherein the anti-backflow accessory comprises a hose-clamping drive motor, a hose-clamping transmission shaft, a hose-clamping swing rod, a hose-clamping connecting rod, a slideway mounting plate, a slideway slider, a slider mounting plate, a pre-pressing limit stop, a hose-clamping limit stop, a movable pre-pressing piece and a movable hose-clamping piece; the hose-clamping transmission shaft is connected to a driving end of the hose-clamping drive motor; one end of the hose-clamping swing rod is connected to the hose-clamping transmission shaft; the other end of the hose-clamping swing rod is connected to a sliding assembly through the hose-clamping connecting rod; and the sliding assembly comprises the slideway mounting plate, the slideway slider and the slider mounting plate.

8. The linear peristaltic metering pump as recited in claim 7, wherein the pre-pressing limit stop, the hose-clamping limit stop, the movable pre-pressing piece and the movable hose-clamping piece form the second clamp, and the second clamp is arranged on the slideway slider.

9. The linear peristaltic metering pump as recited in claim 8, wherein the movable pre-pressing piece and the pre-pressing limit stop are located at one side of the sliding assembly; the movable hose-clamping piece is located at the other side of the sliding assembly; the movable pre-pressing piece and the pre-pressing limit stop are arranged in relative positions to form a first space for the working hose to pass therethrough; the movable hose-clamping piece and the hose-clamping limit stop are arranged in a relative position to form a second space for the working hose to pass therethrough; and the working hose is deposited in the first space and the second space.

* * * * *